US008237096B1

(12) United States Patent
Alexander et al.

(10) Patent No.: US 8,237,096 B1
(45) Date of Patent: Aug. 7, 2012

(54) MORTAR ROUND GLIDE KIT

(75) Inventors: Steven B. Alexander, Orange, CA (US); Richard Redhead, Mission Viejo, CA (US)

(73) Assignee: Interstate Electronics Corporation, A Subsidiary of L-3 Communications Corporation, Anaheim, CA (US)

( * ) Notice: Subject to any disclaimer, the term of this patent is extended or adjusted under 35 U.S.C. 154(b) by 168 days.

(21) Appl. No.: 12/806,742

(22) Filed: Aug. 19, 2010

(51) Int. Cl.
*F42B 10/00* (2006.01)
*F42B 10/38* (2006.01)

(52) U.S. Cl. ..... 244/3.25; 102/384

(58) Field of Classification Search ..... 244/3.1, 244/3.21, 3.24, 3.25, 3.26, 3.3, 2, 14, 16, 244/120; 102/384, 490
See application file for complete search history.

(56) References Cited

U.S. PATENT DOCUMENTS

| | | | | |
|---|---|---|---|---|
| 2,466,528 | A * | 4/1949 | Wyckoff et al. | 102/384 |
| 5,260,709 | A | 11/1993 | Nowakowski | |
| 5,507,452 | A | 4/1996 | Mayersak | |
| 5,657,947 | A | 8/1997 | Mayersak | |
| 5,866,838 | A | 2/1999 | Mayersak | |
| 5,943,009 | A | 8/1999 | Abbott | |
| 6,237,496 | B1 | 5/2001 | Abbott | |
| 6,254,031 | B1 | 7/2001 | Mayersak | |
| 6,481,666 | B2 | 11/2002 | Frucht | |
| 6,573,486 | B1 | 6/2003 | Ratkovic et al. | |
| 6,779,752 | B1 | 8/2004 | Ratkovic | |
| 6,981,672 | B2 | 1/2006 | Clancy et al. | |
| 7,163,176 | B1 | 1/2007 | Geswender et al. | |
| 7,207,517 | B2 | 4/2007 | McKendree et al. | |
| 7,354,017 | B2 | 4/2008 | Morris et al. | |
| 7,367,525 | B2 | 5/2008 | McKendree et al. | |
| 7,416,154 | B2 | 8/2008 | Bittle et al. | |
| 2008/0061188 | A1 | 3/2008 | Morris et al. | |
| 2009/0084888 | A1 | 4/2009 | Shai | |
| 2010/0057285 | A1 | 3/2010 | Murphy et al. | |

FOREIGN PATENT DOCUMENTS

| | | |
|---|---|---|
| WO | WO2008010226 | 1/2008 |

OTHER PUBLICATIONS

Greg Goebel; [5.0 ]Modern Glide Bombs, [online], Chapter 5, retrieved from the Internet <URL: http://www.vectorsite.net/twbomb_05.html>; Nov. 1, 2008; retrieved on Apr. 16, 2010.
Global Security.Org; Joint Direct Attack Munition (JDAM), [online], retrieved from the Internet <URL: http://www.globalsecurity.org/military/systems/munitions/jdam-pics.htm>; Jan. 25, 2006; retrieved on Apr. 16, 2010.

(Continued)

*Primary Examiner* — Tien Dinh
*Assistant Examiner* — Richard R Green
(74) *Attorney, Agent, or Firm* — Knobbe Martens Olson & Bear LLP

(57) ABSTRACT

Apparatus and methods provide a kit for converting a conventional mortar round into a glide bomb. Mortar rounds are readily available to combat personnel and are small and light enough to be carried by relatively small unmanned aerial vehicles (UAVs) such as the RQ-7 Shadow. Advantageously, the kit provides both guidance and relatively good standoff range for the UAV such that the kit-equipped mortar round can be dropped a safe distance away from the intended target so that the UAV is not easily observed near the intended target.

14 Claims, 16 Drawing Sheets

OTHER PUBLICATIONS

Global Security.Org; Joint Direct Attack Munition (JDAM) Operations, [online], retrieved from the Internet <URL: http://www.globalsecurity.org/military/systems/munitions/jdam-ops.htm>; Apr. 27, 2005; retrieved on Apr. 16, 2010.

Global Security.Org; Joint Direct Attack Munition (JDAM) Design, [online], retrieved from the Internet <URL: http://www.globalsecurity.org/military/systems/munitions/jdam-design.htm>; Apr. 27, 2005; retrieved on Apr. 16, 2010.

Strategy Page; Subject: Smallest Smart Bomb: GD-OTS Demos Air-Dropped 81mm Precision Mortar Round, Warplane Weapons Discussion Boards; [online]; retrieved from the Internet <URL: http://www.strategypage.com/militaryforums/387-2048.aspx>; retrieved on Apr. 22, 2010.

Strategy Page; Smallest Smart Bomb: GD-OTS Demos Air-Dropped 81mm Precision Mortar Round, Warplane Weapons Discussion Boards [online]; retrieved from the Internet <URL:http://www.strategypage.com/militaryforums/387-2048/page2.aspx>; retrieved on Apr. 22, 2010.

Defense Industry Daily; Mortars from Aircraft? The Shadow Knows . . . , [online]; retrieved from the Internet <URL: http://www.defenseindustrydaily.com/Mortars-from-Aircraft-The-Shadow-Knows-05226/>; Jan. 4, 2009; retrieved on Apr. 22, 2010.

General Dynamics News; General Dynamics Demonstrates Precision Strike Capability for Tactical UAVs with 81mm Air-Dropped Guided Mortar, [online], retrieved from the Internet <URL: http://www.generaldynamics.com/news/press_releases/2010/NewsRelease%20April%201,%202010.htm>; Apr. 1, 2010; retrieved on Apr. 27, 2010.

General Dynamics News; General Dynamics Completes Successful Flight Demonstration of Air-Dropped Guided Mortar, [online], retrieved from the Internet <URL: http://www.generaldynamics.com/news/press_releases/2008/NewsRelease%20December%2016,%202008.htm>; Dec. 16, 2008; retrieved on Apr. 27, 2010.

* cited by examiner

MORTAR ROUND GLIDE KIT

BACKGROUND

1. Field of the Invention

The invention generally relates to a kit for satellite positioning system based guidance of munitions, and in particular, for a kit for conversion of a mortar round to a guided glide bomb.

2. Description of the Related Art

Various unmanned aerial vehicles (UAVs) exist. These UAVs are aircraft that fly without a human crew on board. Examples of UAVs include, for example, the MQ-1 Predator, the MQ-9 Reaper, the RQ-7 Shadow, and others.

One of the advantages of a UAV is that a UAV can loiter in an area for reconnaissance for relatively long periods and is typically difficult to observe. Relatively large UAVs, such as the MQ-1 Predator and the MQ-9 Reaper, can be equipped to carry munitions, such as AGM-114 Hellfire missiles, which can then be fired at a safe distance away from a target. This can save the time it takes to deploy aircraft or the like, and prevent lost opportunities. However, these relatively large UAVs can be expensive to procure and to operate, and typically need airfields from which to operate.

Smaller UAVs, such as the RQ-7 Shadow, are much cheaper than the larger UAVs and are more readily deployable in the field without an airfield. However, these smaller UAVs typically fly at much lower altitudes, at much lower speeds, and have much less load carrying capacity. For example, the RQ-7 Shadow does not have the load carrying capacity to carry large munitions or to carry relatively many munitions unless the munitions are relatively small and light.

Instead, these smaller UAVs can be equipped to drop relatively small gravity bombs when needed. A mortar round is a widely available and relatively lightweight bomb. One example of a conventional kit for guidance of a mortar round is the Roll Controlled Fixed Canard (RCFC) guidance kit by General Dynamics Corp. The RCFC guidance kit appears to be described in U.S. Pat. No. 7,354,017 to Morris, et al., (the '017 patent) which, according to the U.S.P.T.O's assignment records, is assigned to General Dynamics Ordnance and Tactical Systems, Inc. In the '017 patent, FIG. 1 illustrates a projectile control system, FIG. 2 illustrates a mortar round configuration, FIG. 3 illustrates a rocket configuration, FIG. 4 illustrates a projectile, such as a rifled mortar round.

The guidance kit permits the trajectory of a mortar round to vary from a normal ballistic trajectory. For example, the '017 patent describes that "the control section is de-spun to 0 Hz," and then control surfaces 15 control the trajectory of the projectile. The '017 patent describes that "the control surfaces 15 may be deployable fixed-angle canards, which are initially retracted and are deployed during or after launch of the projectile." These canards are initially retracted such that the mortar round can still be launched from a mortar tube.

As illustrated in FIG. 2 with the circular arrows, the mortar round configuration is intended for a mortar round that spins after being shot from a mortar tube. However, the configuration is also applicable to being dropped from the air as described in a General Dynamics press release of Dec. 16, 2008, which describes a test in which an 81 mm mortar round was dropped from an aircraft, and a General Dynamics press release of Apr. 1, 2010, which describes the dropping of an 81 mm mortar round from a UAV.

In normal operation, a UAV operates stealthily and goes unnoticed. However, when a conventional mortar round is dropped from a UAV, the UAV becomes relatively easy to spot from the ground as it is flying nearly directly overhead due to the relatively low speed and low altitude operation of these UAVs. The UAV is then vulnerable to being shot down with ground fire, thereby negating the cost advantages of these smaller UAVs. Even when the mortar round is guided via a conventional kit, the UAV must still be flying nearly directly overhead of the target, which is a disadvantage referred to as having almost no standoff range. While a guidance kit attached to a mortar round can steer the mortar round to the target for greater accuracy to compensate for effects such as crosswinds, such conventional guidance kit equipped mortar rounds must still be dropped nearly directly overhead of the target, which renders the dropping UAV vulnerable to ground fire.

SUMMARY

The invention includes a kit for converting a conventional mortar round into a glide bomb. Mortar rounds are readily available to combat personnel and are small and light enough to be carried by relatively small unmanned aerial vehicles (UAVs). Embodiments of the invention advantageously exhibit enhanced standoff range, which makes the deploying UAV much more difficult to detect and shoot down after the mortar round has been dropped.

BRIEF DESCRIPTION OF THE DRAWINGS

These drawings and the associated description herein are provided to illustrate specific embodiments of the invention and are not intended to be limiting.

DETAILED DESCRIPTION OF SPECIFIC EMBODIMENTS

Although particular embodiments are described herein, other embodiments of the invention, including embodiments that do not provide all of the benefits and features set forth herein, will be apparent to those of ordinary skill in the art.

Cost and availability are problems that can be encountered in the field with sophisticated munitions, such as the AGM-114 Hellfire missile. Careful storage of explosive devices is another aspect that must be considered for deployment.

On the other hand, one item that is relatively inexpensive and typically inventoried in ample supply is a mortar round. Mortar rounds are typically widely available to infantry. A conventional mortar round contains a warhead and a cavity for propellant, which the mortar round uses to launch itself from a mortar. Typically, mortar rounds are standardized in 60 millimeter (mm) and 81 mm diameters. However, other diameters exist. These 60 mm and 81 mm mortar rounds are typically light enough to be carried by a small UAV, such as by an RQ-7 Shadow.

These small UAVs fly at low altitudes and at low speeds. Accordingly, when these small UAVs drop a small explosive, such as a conventional mortar round, the UAV would typically be positioned nearly directly overhead of the target, and since the UAV would be flying at a low altitude and at low speed, the UAV becomes quite vulnerable to ground fire and to being shot down.

Embodiments of the invention provide a way of delivering a mortar round to a distant target from a small UAV, while maintaining the UAV at a safe distance away from the target. This increases the likelihood that the UAV will remain aloft for further reconnaissance or surveillance and will be able to return safely for further use, thereby increasing combat effectiveness and decreasing cost. One embodiment of the invention is a kit that is attached to the exterior of a mortar round. For example, the kit can include wings for gliding, a GPS (Global Positioning System) receiver and an inertial measurement unit (IMU) for positioning information, a navigation processor for guidance of the mortar round to the intended target, servos to control flight via control surfaces on the wings, and a power source for powering various components. For example, a kit can be strapped to a mortar round. The original mortar round fuze can be replaced with another fuze more suitable for air dropping, which can be included in the kit.

Advantageously, components for the kit do not contain explosive materials and can be shipped and stored without special handling. The kits can be combined with mortar rounds commonly available in the field to provide small UAVs with glide bomb capability.

Figure 1:
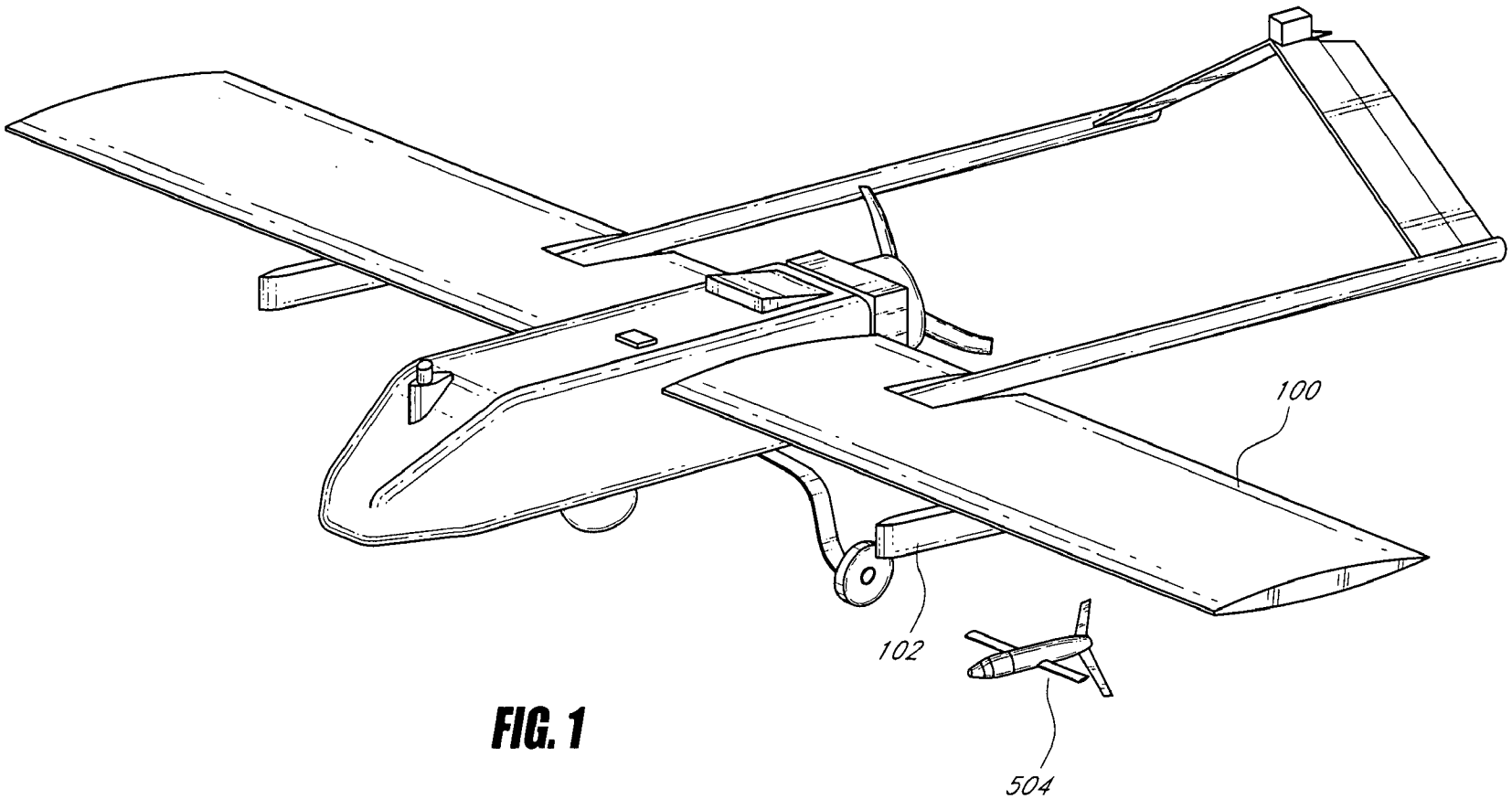
FIG. 1 illustrates an example of a small unmanned aerial vehicle (UAV).

FIG. 1 illustrates an example of a small unmanned aerial vehicle (UAV) 100. An RQ-7 Shadow, which is an example of a small UAV having relatively low-speed, low-altitude, and low load carrying capability. The UAV 100 can carry ordnance on a launcher 102, which can be a weapons rack. However, conventional kits do not provide mortar rounds with adequate standoff range due to the relatively low glide ratio of the glide-kit equipped mortar round and the relatively low airspeed of a small UAV (around 60 mph). While the flight path of a conventionally-guided mortar round can be varied somewhat from the ballistic trajectory to permit control, the modified trajectory varies only slightly from the ballistic trajectory so that a UAV that is carrying the ordnance must drop the ordnance nearly directly above the intended target, which would render the UAV vulnerable to ground fire.

For example, conventionally, a conventional mortar round has a glide ratio of about 0.1:1 and is much less than 1:1. The glide ratio is a ratio of forward distance to downwards distance traveled while gliding at a constant speed (assuming no wind). Embodiments of the invention advantageously provide a mortar round guidance kit having a glide ratio of at least 1:1, which permits the UAV 100 to deploy a guided mortar round from a safe and unobtrusive distance. One embodiment of a fitted mortar round assembly 504 is illustrated in FIG. 1 in a position corresponding to having recently been dropped from the UAV 100.

Figure 2:
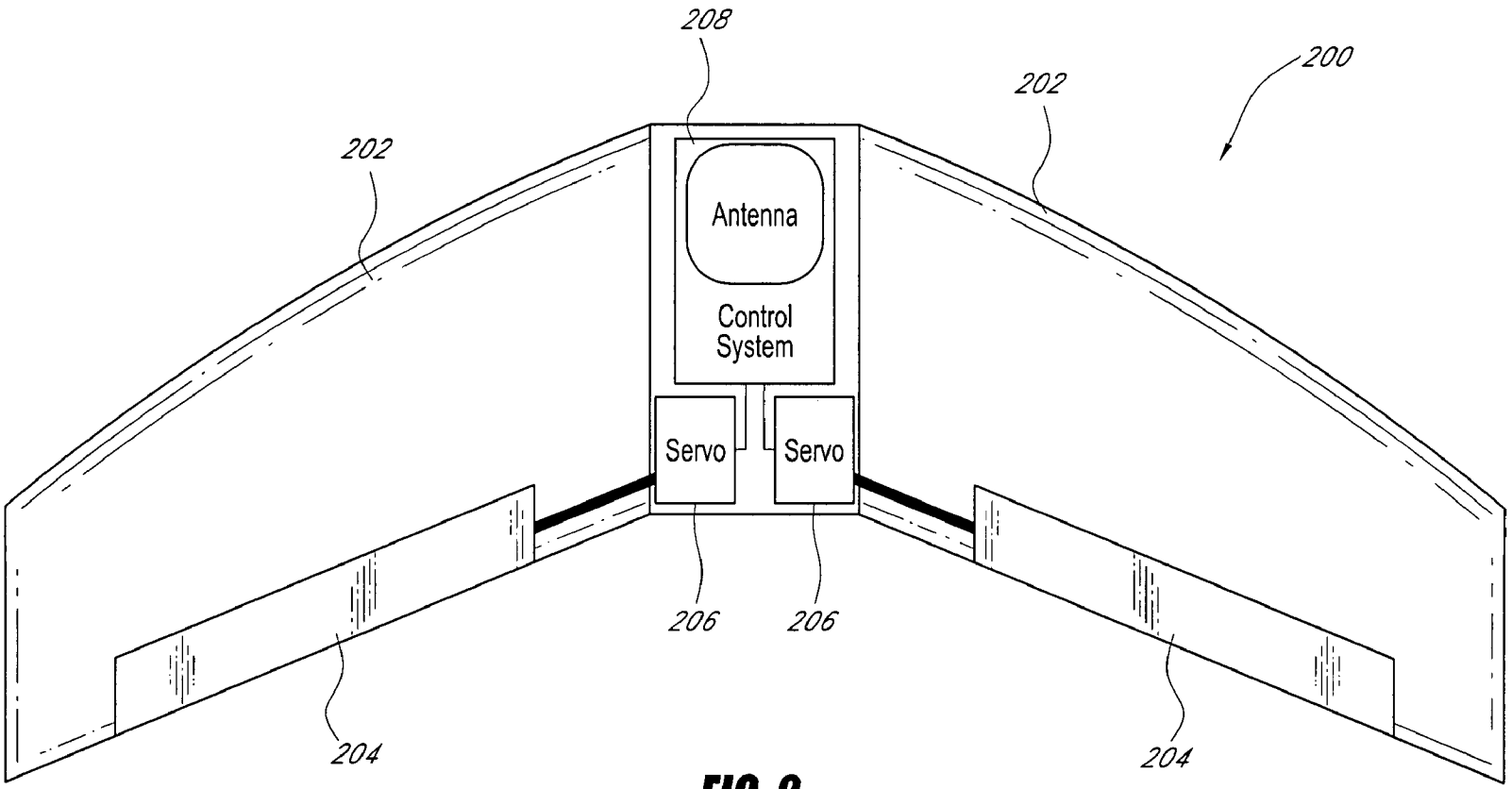
FIG. 2 illustrates a top-view of an embodiment of a mortar round glide kit.

FIG. 2 illustrates a top-view of one embodiment of a mortar round glide kit 200. The kit 200 includes a wing assembly, straps (not shown in FIG. 2), servos, and a positioning system. The wing assembly can include one or more rigid portions 202 and two or more movable control surfaces 204 for lift and control. Servos 206 actuate the movable control portions of the wing assembly for steering of the mortar round. The servos 206 operate under the control of a control system 208, which can include or cooperate with a guidance and flight control computer for steering to a target.

The control system 208 can include, for example, a satellite positioning system receiver, an inertial measurement unit (IMU), and an antenna for receiving satellite signals. In one embodiment, the antenna is positioned within the kit 200 so that the antenna is mounted adjacent to a top lengthwise side of the mortar round. The lengthwise side is appropriate because with a glide angle of at least 1:1, the mortar round assembly is closer to being level flight than it is to a vertical drop. In one example of the prior art, the antenna of the conventional kit is mounted at the rear of the mortar round because when the mortar round is dropped, the mortar round's trajectory is nearly straight down, and the rear of the conventional mortar round points toward the sky.

In the illustrated embodiment, the control system 208 also includes a power source, such as one or more batteries for powering electronics and the servos 206, but the power source can also be external to the control system 208. In the illustrated embodiment, the satellite positioning system used is the NAVSTAR Global Positioning System (GPS). To save cost, one embodiment uses only the L1 signals from the GPS satellites. In alternative embodiments, other signals, such as the L2 signals, are used. Other satellite positioning systems, such as Galileo and GLONASS will also be applicable.

The control system 208 determines position using a combination of satellite positioning data, such as GPS, and data from the IMU. Typically, before the fitted mortar round assembly is dropped, a target or destination is uploaded from the UAV to the positioning system under the control of ground personnel. Of course, the target or destination can alternatively be programmed in advance of the flight of the UAV.

In one embodiment, the guidance and flight control computer of the control system 208 calculates a flight path, which, in one embodiment, corresponds to a vector (without magnitude) that points from the current position of the fitted mortar round assembly 304/504 to the target. The flight control is typically implemented using a microprocessor executing program instructions. The program instructions and other instructions of the control system 618 can be stored in a non-transitory tangible, computer-readable medium, such as a ROM, PROM, EEPROM, Flash memory, or the like. Using the servos 206, the control system 208 can actuate the control surfaces 204 to guide the fitted mortar round assembly 304/504 to the target. In another embodiment, a flight path is calculated and an actual flight path is observed, and the guidance and flight control computer of the control system 208 seeks to control the path of the fitted mortar round glide kit to minimize the difference between the calculated flight path and the actual flight path.

Figure 3:
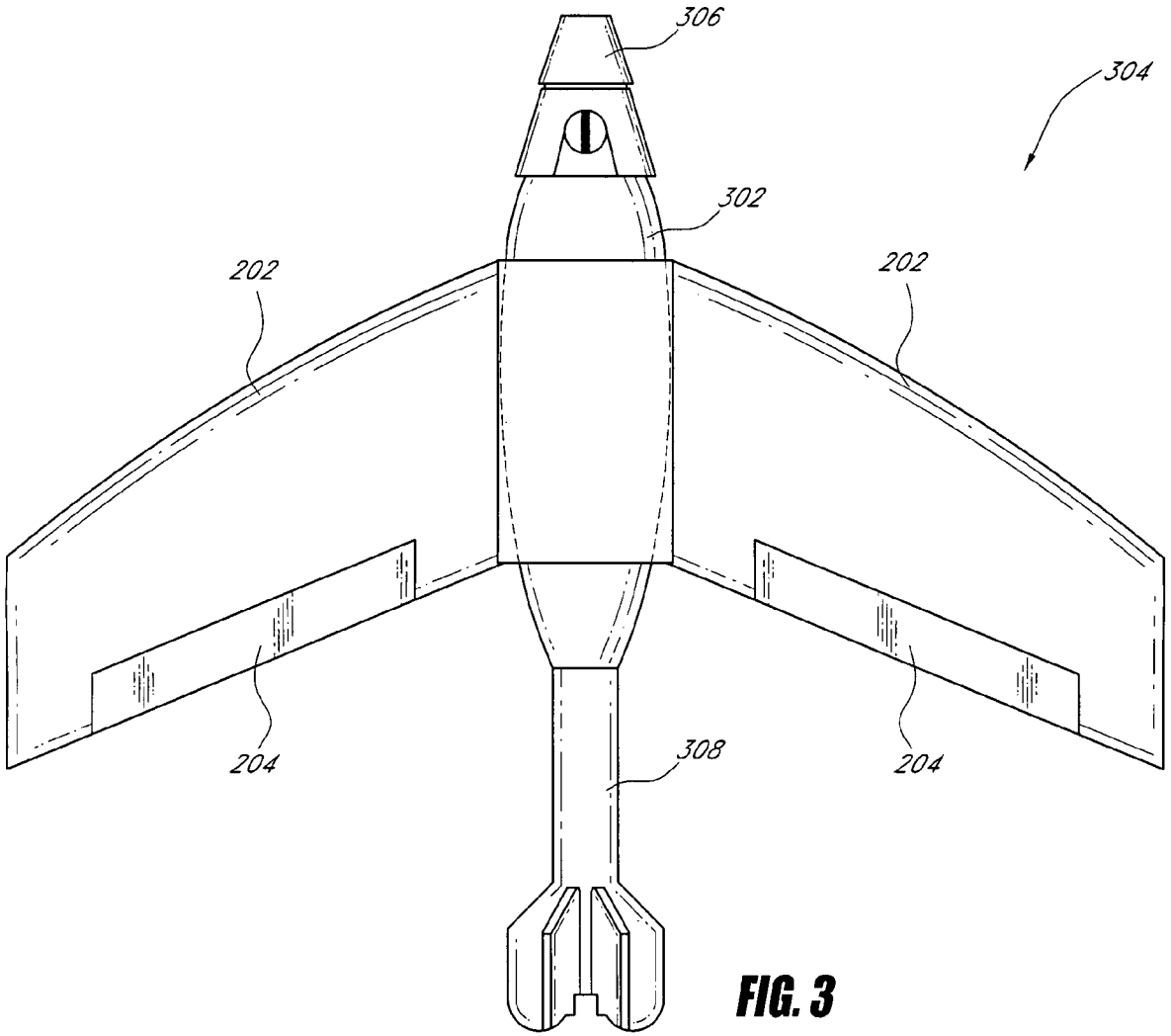
FIG. 3 illustrates a top-view of an embodiment of the mortar round glide kit as attached to a mortar round.

FIG. 3 illustrates a top-view of the mortar round glide kit 200 described earlier in connection with FIG. 2 with a mortar round 302 attached to form a fitted mortar round assembly 304. The mortar round 302 can have a fuze 306 and a tail section 308. In one embodiment to be described later in connection with FIGS. 5, 6, 7A-7D, 8, and 9A-9D, the conventional tail section 308 of the mortar round 302 is not used. One embodiment of the mortar round glide kit 200 includes a hard point attachment for attaching to the launcher 102. As illustrated in FIG. 3, the one or more rigid portions 202 and the two or more movable control surfaces 204 are relatively large compared to the mortar round 302 to provide the fitted mortar round assembly 304 with relatively high glide ratios of at least 1:1 for a minimum of a 45-degree glide slope. For example, two examples of wing configurations intended for a kit for a 60 millimeter mortar round will be described in the following. The wings can be of a folded configuration for more compact storage.

A first example is a wing with the following characteristics: 5" chord, 20" wingspan, 0.64 square foot wing area, an aspect ratio of around 4, coefficient of lift of around 1.2 with a flat bottom wing, an angle of attack of about 5 degrees, a camber of 5% of the chord, and a thickness of 8% of the chord. Such a wing can be expected to have a lift to drag ratio far exceeding unity, which should provide for a glide ratio much higher than 1:1, such as over 10:1. The glide ratios can be even higher, such as 2:1, 2.5:1, 3:1, 3.5:1, 4:1, and so forth.

A second example is a wing with the following characteristics: 2.6" chord, 20" wingspan, 0.35 sq ft wing area, an aspect ratio of 7.2, coefficient of lift of 1.2 with a flat bottom wing, an angle of attack of 5 degrees, a camber of 5% of the chord, and a wing thickness of 8% of the chord. Such a wing can be expected to have a lift to drag ratio substantially exceeding unity, which should provide for a glide ratio much higher than 1:1. In one embodiment, the glide ratio is about 3:1, so that the fitted mortar round assembly 304 can glide about 3 miles starting from an altitude of a mile once a steady-state speed has been achieved.

Figure 4:
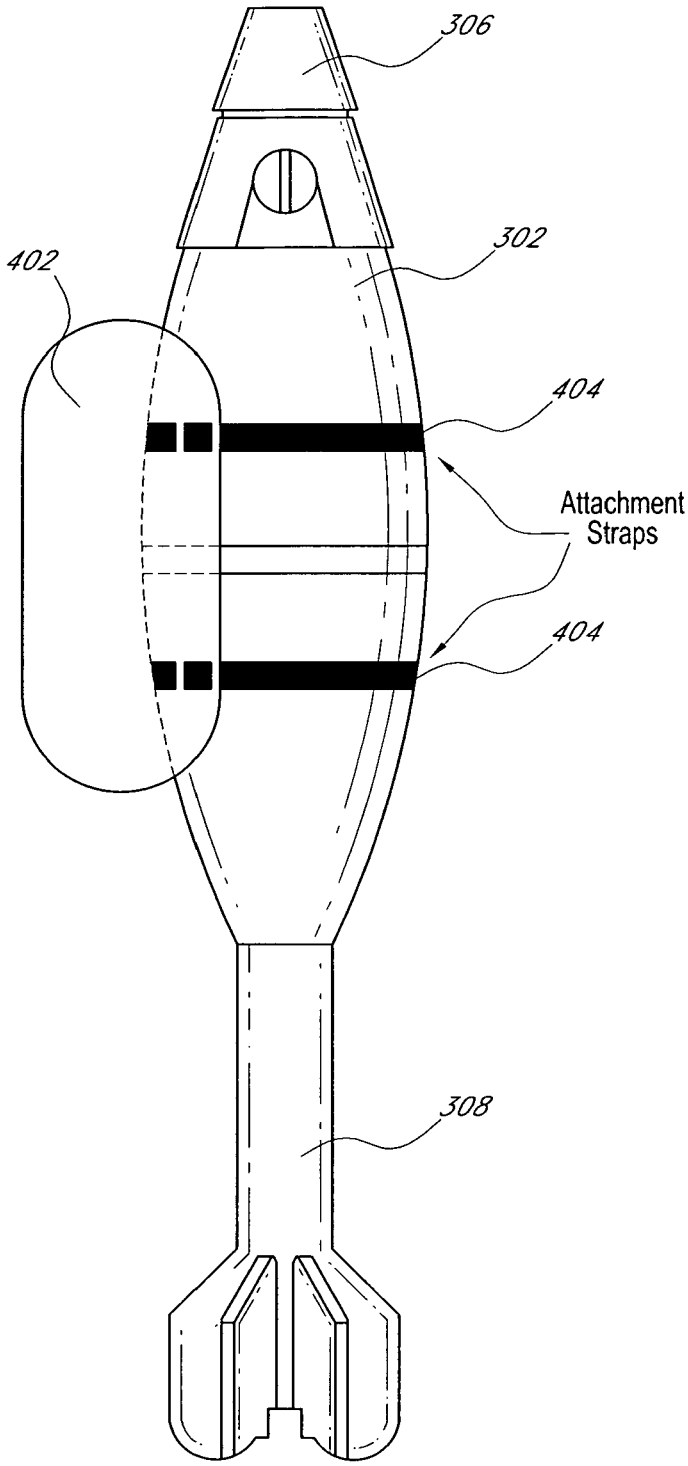
FIG. 4 illustrates a side-view of an embodiment of the mortar round glide kit as attached to a mortar round.

FIG. 4 illustrates a side-view of an embodiment of the mortar round glide kit as attached to the mortar round 302. To take advantage of the typically plentiful supply of mortar rounds, the mortar round glide kit 402 is preferably configured to attach to the mortar round 302 in a manner that can be performed in the field. In the illustrated embodiment, the mortar round glide kit 402 includes one or more straps 404 that extend at least partially around an external surface of the mortar round 302 for attachment of the wing assembly to the mortar round 302. For example, the straps 404 can correspond to band clamps that extend around the mortar round 302.

Figure 5:
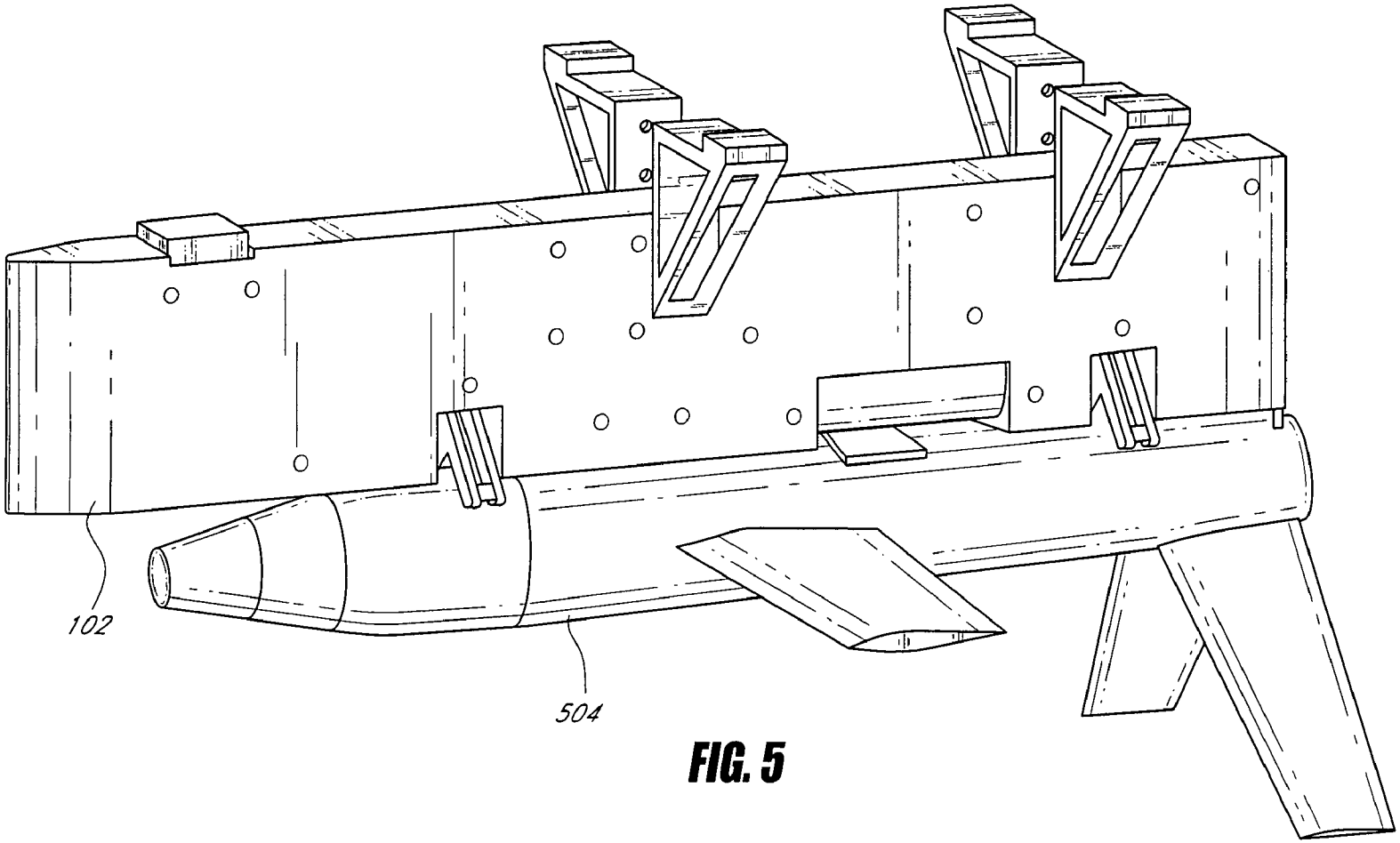
FIG. 5 illustrates another embodiment of a fitted mortar round assembly attached to a launcher.
Figure 6:
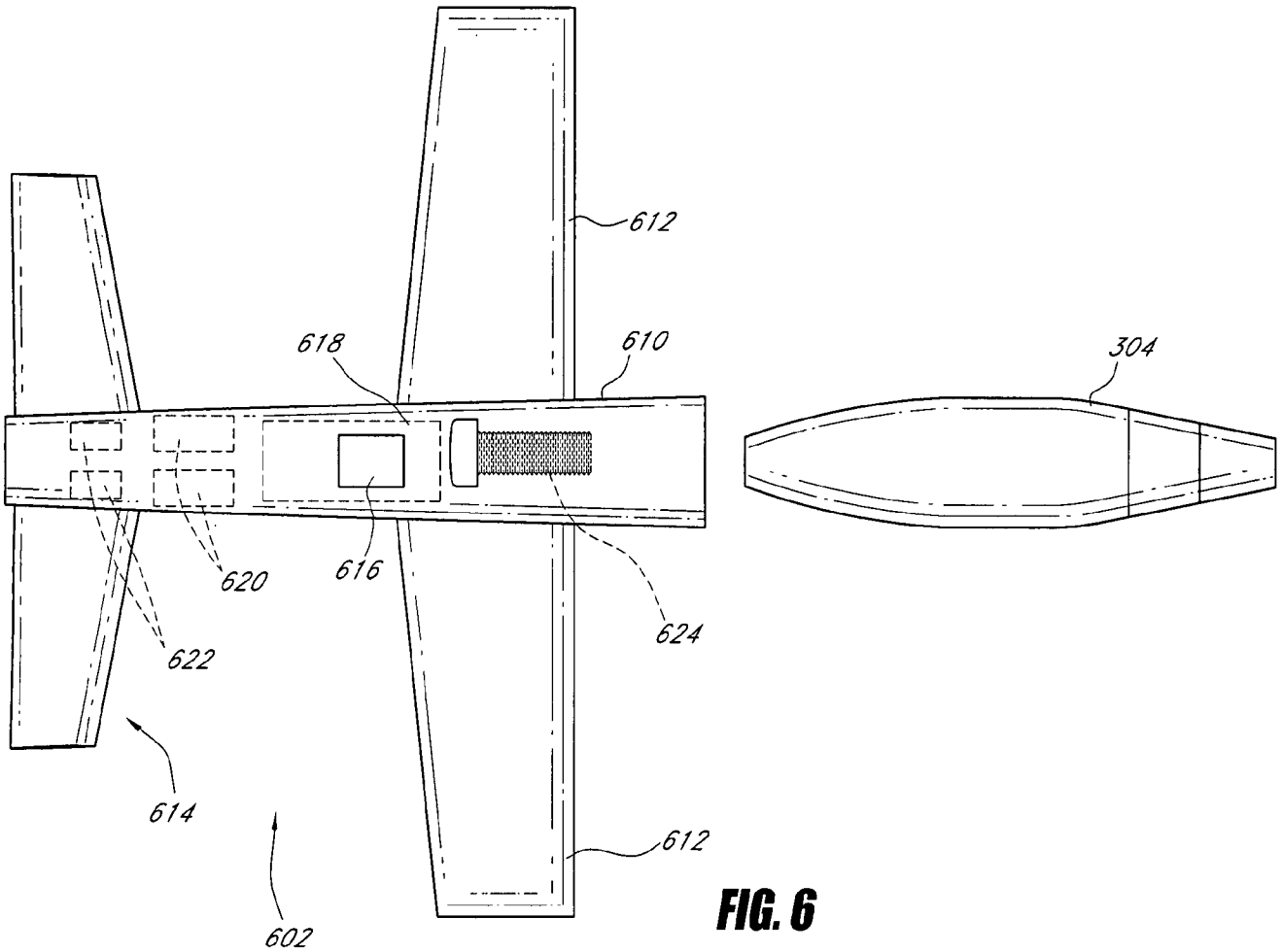
FIG. 6 illustrates components of the fitted mortar round assembly illustrated in FIG. 5.

FIG. 5 illustrates another embodiment of a fitted mortar round assembly 504 attached to the launcher 102. 60 mm and the 81 mm mortar rounds have detachable passive tail sections. As illustrated in FIG. 6, one embodiment includes a mortar round glide kit 602 that is configured to attach to a body 304 of a mortar round without the tail section, for example, with its tail section removed. The embodiment illustrated in connection with FIGS. 5, 6, 7A-7D, 8, and 9A-9C is sized to mate with a 60 mm, but the principles and advantages disclosed herein are applicable to mortar rounds of other diameters.

As illustrated in FIG. 6, illustrates an example of a component layout for the fitted mortar round assembly 504 illustrated in FIG. 5. For clarity, the body 304 of the mortar round and the mortar round glide kit 602 are shown not connected. The illustrated embodiment of the fitted mortar round assembly 504 includes a housing 610, front wings 612, tail fins 614, an antenna 616, a control system 618, a power source 620, servos 622 for actuating one or more of the tail fins 614, and a threaded joint 624. The housing 610, front wings 612, and tail fins 614, can be considered to be a wing assembly.

As discussed earlier in connection with the control system 208 of FIG. 2, the antenna 616 and the control system 618 can correspond to components for Global Positioning Systems (GPS). In the illustrated embodiment, the antenna 616 is generally oriented from a top-side of the housing 610 such that the antenna 616 has a relatively good orientation for receiving signals from space vehicles or satellites while the fitted mortar round assembly 504 is in a glide path. By contrast, a mortar round kit in which the mortar round is not intended to glide will typically have an antenna pointing from a tail of the mortar round, as the mortar round drops nearly vertically. The control system 618 can also include a supplemental navigation aide, such as an inertial measurement unit (IMU) and/or a magnetometer, or even a terminal guidance system, such as semi-active laser seeker or infrared terminal guidance. The control system 618 can also include or cooperate with a guidance and flight control computer for steering to the target, as discussed earlier in connection with the guidance and flight control computer of the control system 208 (FIG. 2). For example, the guidance and flight control computer can control one or more of the tail fins 614 or other control surfaces via the servos 622. An embodiment with 3 tail fins 614 will be described in greater detail in connection with FIGS. 7A-7D and 8.

The power source 620 can be any suitable power source, such as, but not limited to, batteries, fuel cells, generators, etc. For example, a wide range of batteries can be used. Batteries with a relatively high energy density and good performance at cold temperatures should be selected. For example, the batteries can correspond to rechargeable batteries, such as lithium polymer batteries, which can be charged by field personnel prior to launch of the UAV 100 or by the UAV 100 itself. Non-rechargeable batteries of a standard cell size, such as AA or AAA, such as readily available alkaline batteries or lithium iron disulfide batteries can be used. Of course, application specific batteries or more exotic battery types can also be used.

In the illustrated embodiment, the threaded joint 624 of the mortar round glide kit 602 is used to attach the body 304 of the mortar round to the mortar round glide kit 602. However, other techniques of joining the body 304 of the mortar round or another portion of the mortar round to the mortar round glide kit 602 are applicable, such as, but not limited to clamping, adhesives, magnets, rivets, welding, brazing, fasteners such as bolts, screws (by tapping holes in the mortar body), etc.

In one embodiment, the threaded joint 624 is threaded to match the threads of the body 304, which for a standard mortar round are normally used for attachment of the tail section of the mortar round. For example, the threaded tube can be attached to a portion of the housing 610, can be retained within the housing 610, can be formed with the housing 610, or the like. The threaded joint 624 can be fabricated from a wide variety of materials, including, but not limited to, plastic or a composite material, metal, such as steel, or the like. In the illustrated embodiment, a bolt is shown for the threaded joint 624. In an alternative, embodiment, a threaded hollow pipe is used for the threaded joint 624 to save weight. Further details of one embodiment of the housing 610 will be described in greater detail later in connection with FIGS. 9A-9C.

Figure 7A:
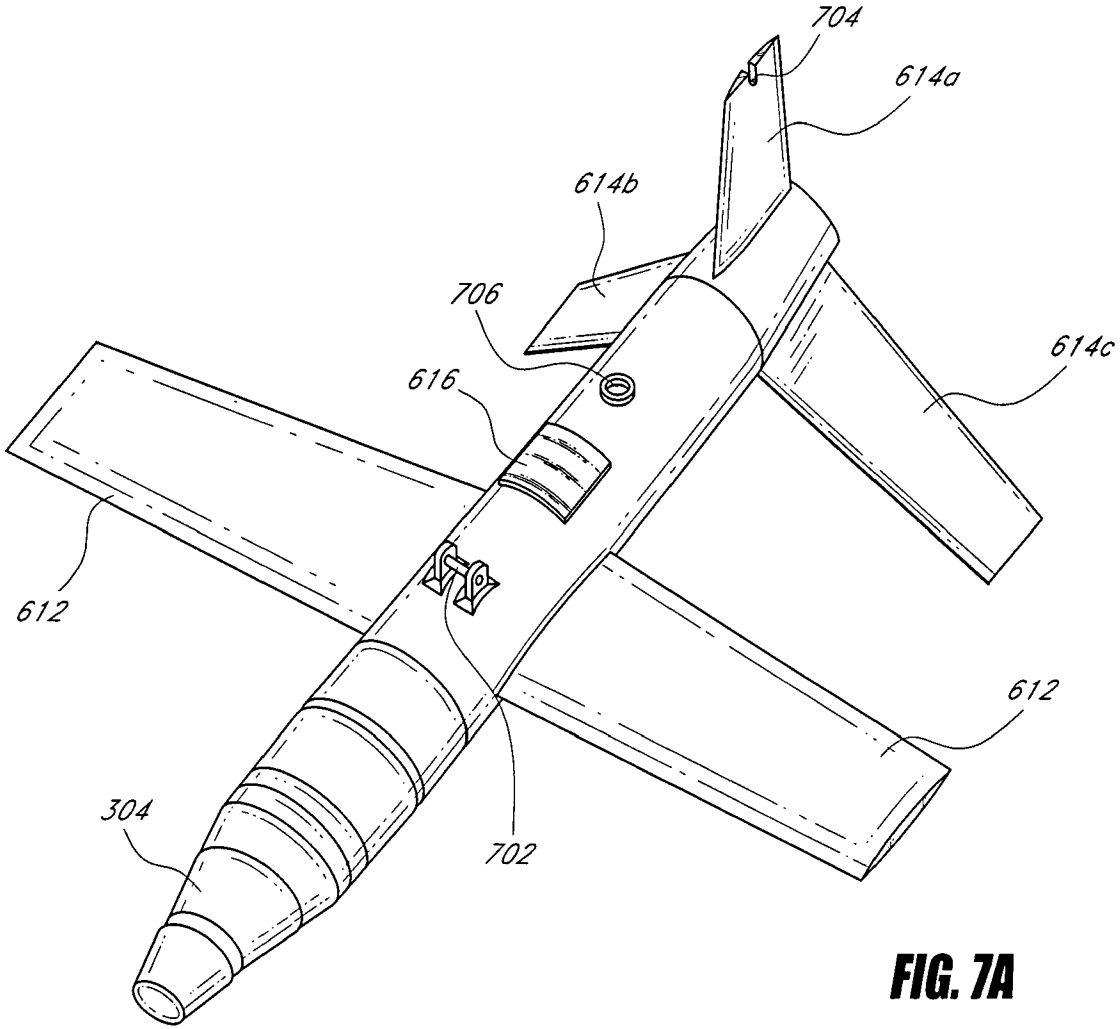
FIGS. 7A-7D illustrate various views of the embodiment of the fitted mortar round assembly illustrated in FIG. 5.
Figure 7B:
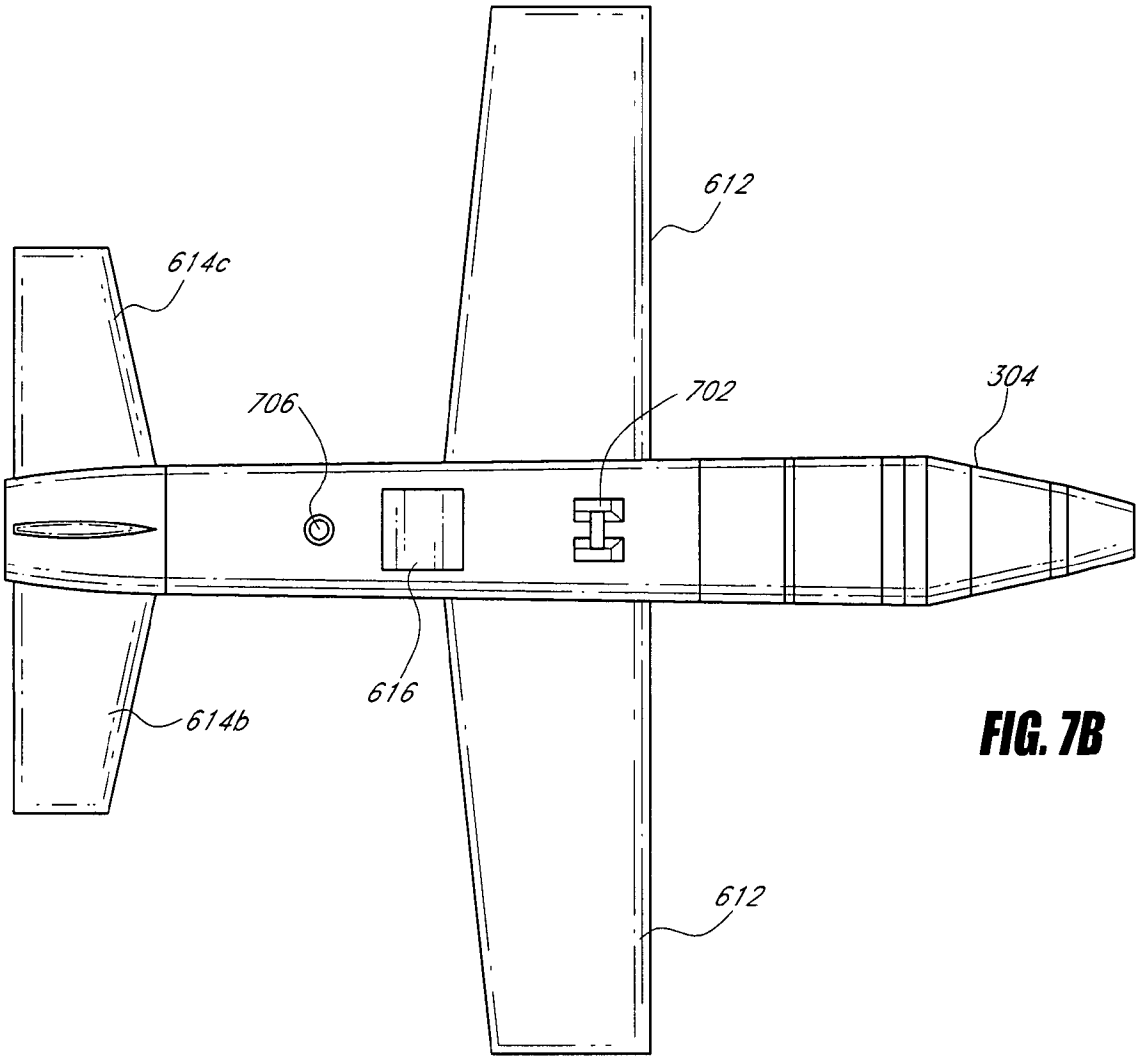
Figure 7C:
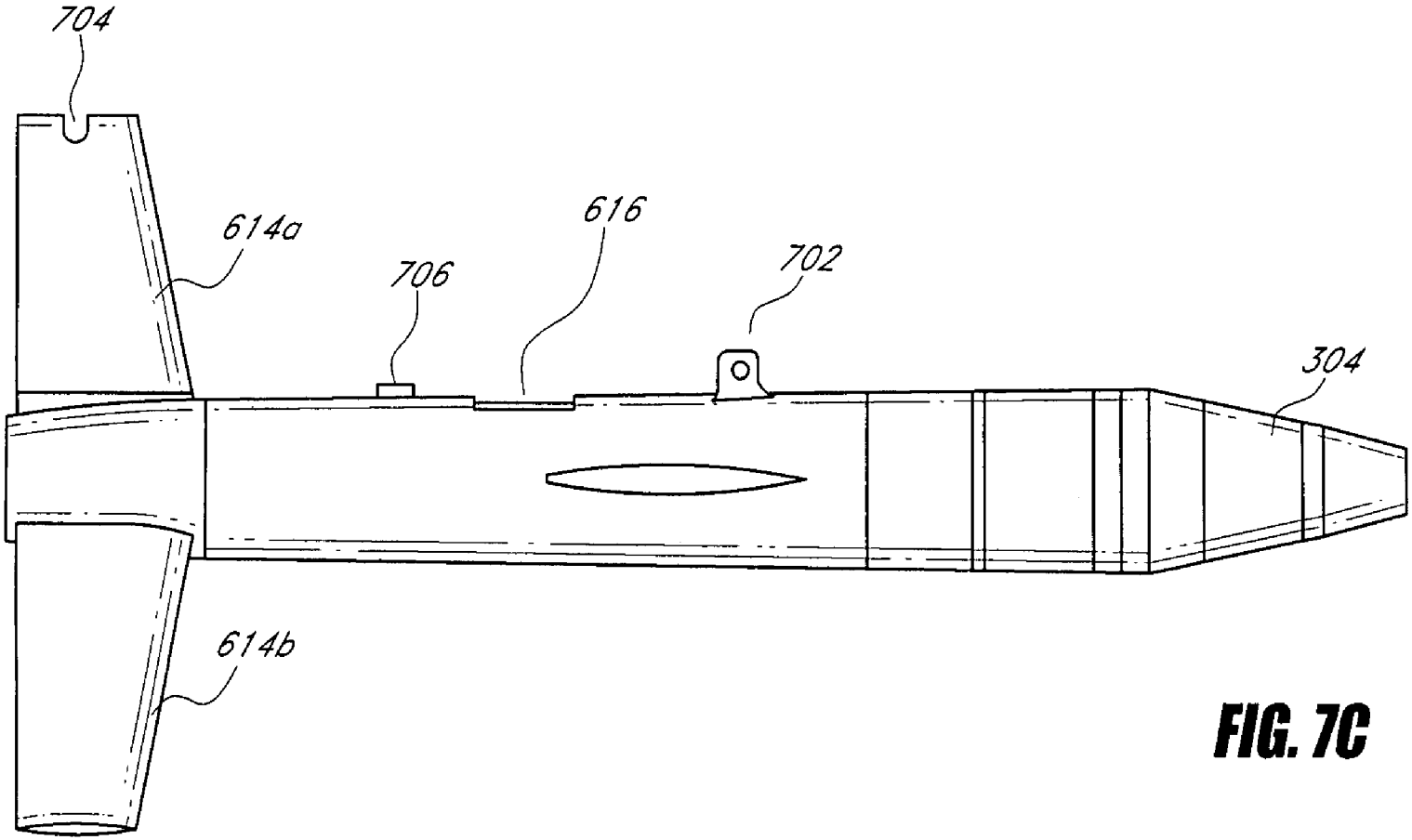
Figure 7D:
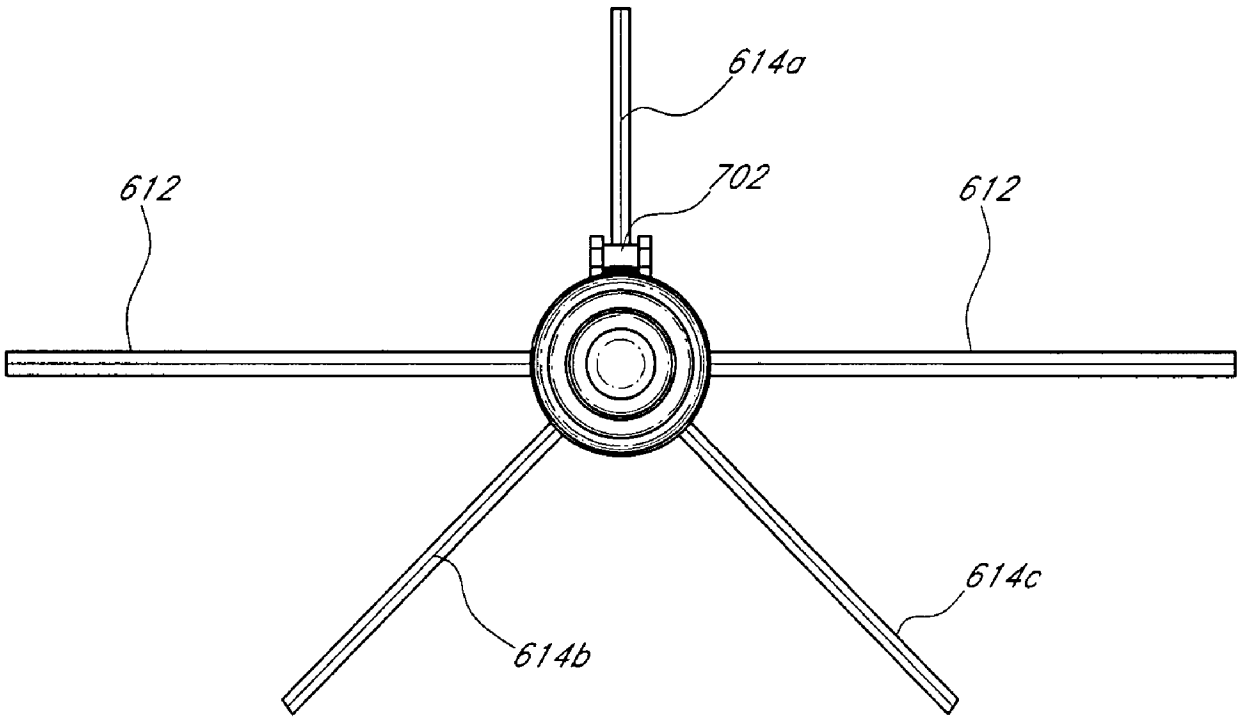
Figure 8:
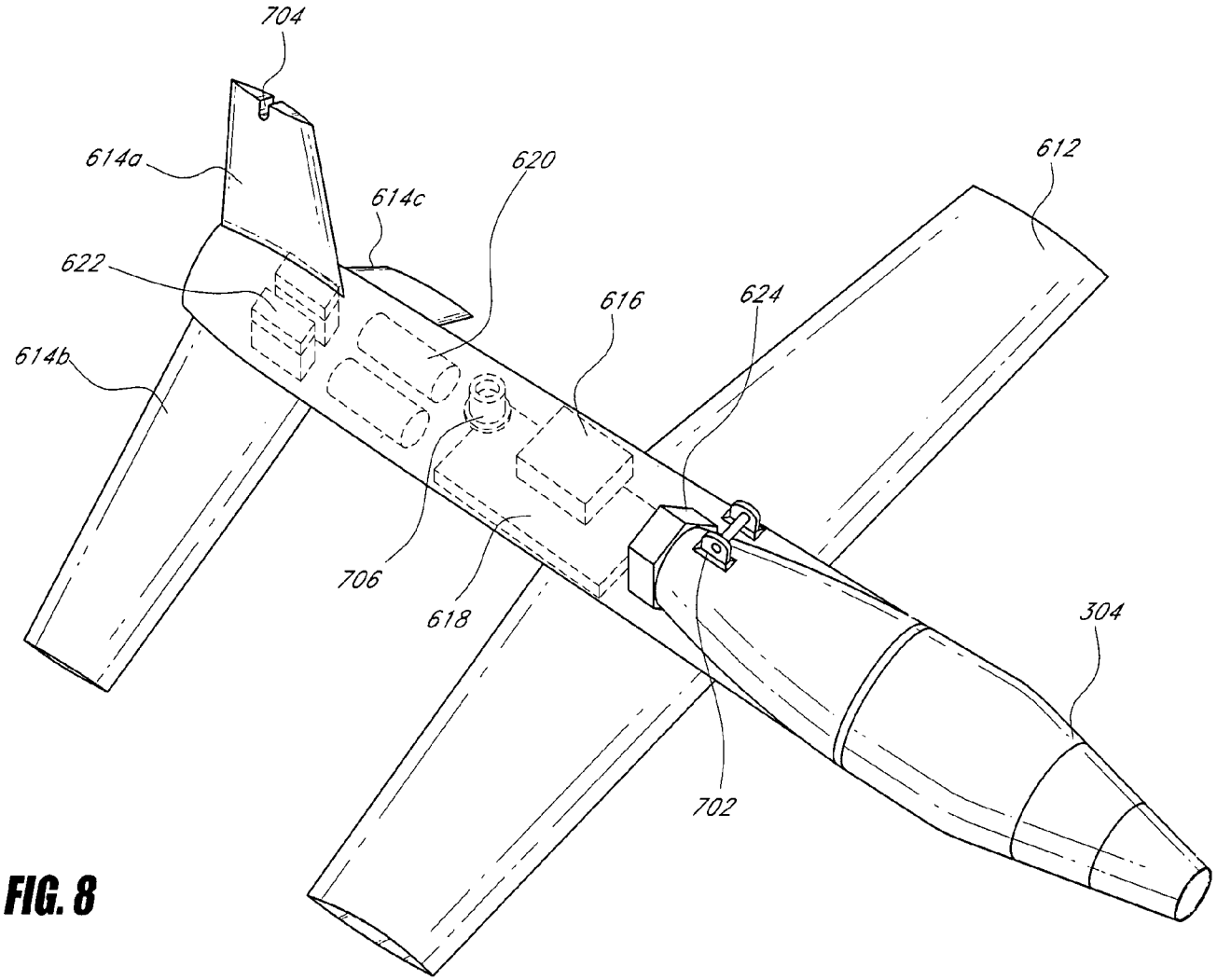
FIG. 8 illustrates additional components of the fitted mortar round assembly illustrated in FIG. 5.

FIGS. 7A-7D illustrate various views of the embodiment of the fitted mortar round assembly 504 illustrated in FIG. 5. FIG. 7A corresponds to a front perspective view. FIG. 7B corresponds to a top view. FIG. 7C corresponds to a side view. FIG. 7D corresponds to a front view. FIG. 8 illustrates another perspective view.

FIG. 7A illustrates a forward latch 702, an aft guide 704, and a breakaway connector 706. The forward latch 702 and the aft guide 704 can be used by the launcher 102 or by a weapons rack to hold the fitted mortar round assembly 504 until release. Of course, other techniques can be used to attach the fitted mortar round assembly 504 to the launcher 102 until release. The breakaway connector 706 can be used to transfer data to/from the UAV 100 and the fitted mortar round assembly 304/504 and can also be used to transfer power from the UAV 100 to the fitted mortar round assembly 304/504. For example, the UAV 100 can provide the fitted mortar round assembly 304/504 with targeting data, positioning data, and launch messages for arming. For example, targeting data can include a GPS coordinates of the target. Positioning data can include, for example, GPS system time, ephemeris data (space vehicle orbital data from the navigation message of GPS), and the GPS position, velocity, and attitude of the UAV 100, which can assist with a GPS receiver of the control system 618 to acquire GPS signals rapidly when the fitted mortar round assembly 304/504 is released from the UAV 100. An example of data and power being transferred between the UAV 100 and the fitted mortar round assembly 304/504 will be described later in connection with FIG. 11.

The fitted mortar round assembly 304/504 can provide the UAV 100 with one or more indications regarding its health and readiness. With respect to power, a generator or an alternator from the UAV 100 can supply, for example, +28VDC power to the fitted mortar round assembly, which can be used to generate other power biases so as not to drain batteries or to save fuel for the power source 620.

In the illustrated embodiment of FIGS. 7A-7D and 8, the mortar round glide kit 504 has three tail fins 614*a*, 614*b*, 614*c* in an inverted "Y" configuration. A different number of tail fins, such as 0, 1, 2, 4 or more tail fins, can alternatively be used. For example, in another embodiment, the vertical tail fin 614*a* is not needed and only the inverted "V" configuration of the tail fins 614*b*, 614*c* is used. Returning to the illustrated embodiment, the upper, vertical tail fin 614*a* is fixed, and the other two tail fins 614*b*, 614*c* are actuated by the servos 622 for control of the fitted mortar round assembly. Of course, other control surfaces can be used instead. The vertical tail fin 614*a* functions as a vertical stabilizer. The control of the two lower tail fins 614*b*, 614*c* is sufficient to control pitch, roll, and yaw.

In the illustrated embodiment with a 60 mm mortar round body 304, the wing 612 has a span of about 16 inches, a root chord (at the plane of symmetry) of about 3.5 inches, and a tip chord of about 2.5, with a straight leading edge and a forward-swept trailing edge. Wing reference area is about 48 square inches. A broad range of other wing configurations are applicable will be readily determined by one of ordinary skill in the art.

In one embodiment, the housing 610 can have a cylindrical shape that is about 1.5 inches in diameter and is about 9.7 inches in length. The wing 612 can correspond to wing halves or to a single wing, and can be attached to and/or formed with a front end of the housing 610 along the aft 70% of the root chord; the planform for the forward 30% of the root chord can be relieved to match the profile of the mortar body. In one embodiment, the vertical tail fin 614*a* is about 4.25 inches long from the aftbody centerline, and the two lower tail fins 614*b*, 614*c* are 6 inches long. In one embodiment, the fitted mortar round assembly achieves a minimum glide ratio of 5:1.

In addition, a mortar round is typically used with a high approach angle and the warhead is designed accordingly. In one embodiment, the guidance and flight control computer performs terminal maneuvers so that the warhead approach angle is consistent with that of a conventional mortar round. Accordingly, the guidance and flight control computer can guide the fitted mortar round assembly along a flight path until near the target, and then climb and dive at the end to reach the target. Flight control functions will be described in greater detail later in connection with FIG. 10.

The fuze 306 for the mortar round body 304 can be provided separately from the mortar round glide kit or can be included with the kit. The fuze 306 triggers the charge in the mortar round and typically includes safety mechanisms. A conventional mortar round fuze includes a setback safety, which senses the initial launch (g force of a few hundred g) from the mortar tube, and an apex sensor, which senses the apex of the trajectory. Unless both of these events are sensed, the fuze 306 remains unarmed for personnel safety. However, when launched from the UAV 100, the fuze 306 would not encounter the high g force and depending on flight parameters, may not sense an apex.

An appropriate fuze 306 for the mortar round glide kit can be based on the M734A1 multi-option fuze. In one embodiment, a tether safety and a speed sensing safety are employed as safeties to substitute for the setback safety and the apex sensing. The tether safety can be used to detect a mechanical separation from the launcher 102. For example, one end of the tether can be attached to the UAV 100, and the other end to a sensor of the mortar round glide kit that can sense whether or not the tether has been pulled, thereby detecting that launch has occurred. Unless the tether or umbilical cord is pulled, such as via the drop of the fitted mortar round assembly from the UAV 100, the tether safety stays in an unarmed state. Speed sensing can be employed as a safety. Rather than apex sensing, the speed or frequency from a power turbine of the fuze 306 can be used to detect a speed that is greater than would be flown by the UAV 100 but within the speed that can be flown by the fitted mortar round assembly after release. Below a predetermined frequency, the fuze 306 remains unarmed, and above or after this predetermined frequency has been achieved, the fuze 306 can be armed. Other safety and arming techniques will be applicable. In one embodiment, the fuze 306 is configured to detonate upon proximity, such as around 7 feet height of burst (HOB). Point detonation can be employed as a backup.

Figure 9A:
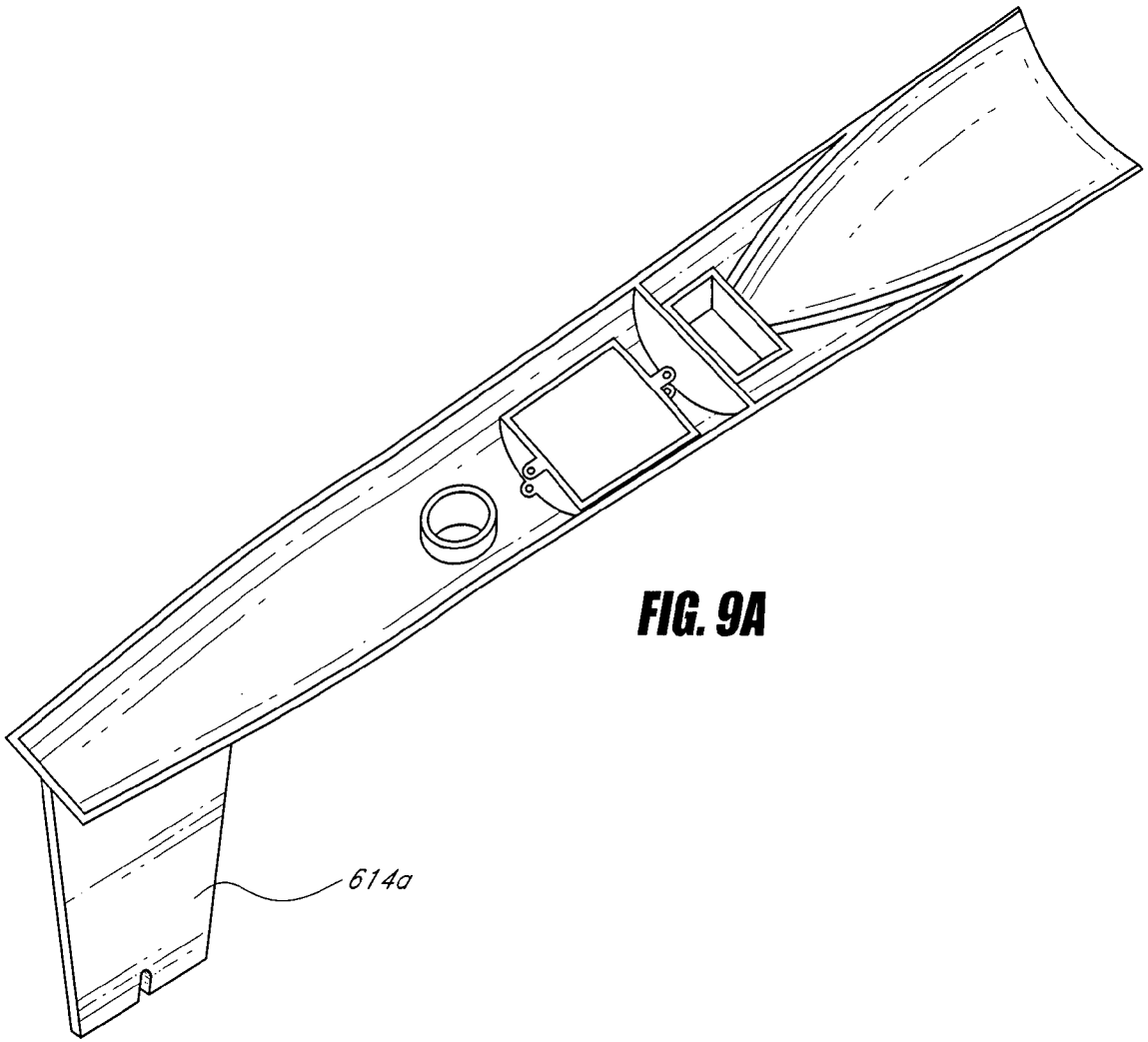
FIG. 9A illustrates a bottom perspective view of an upper portion of a housing for an embodiment of a mortar round assembly.
Figure 9B:
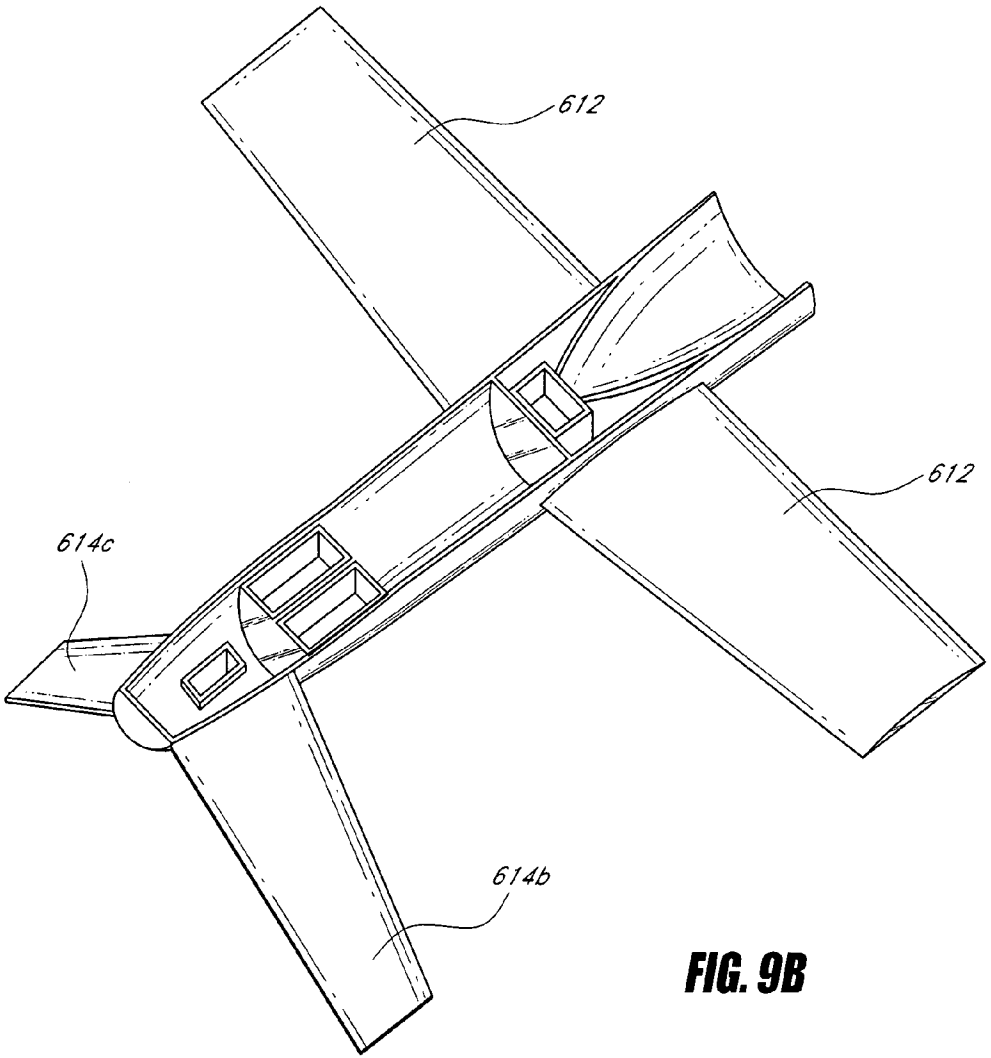
FIG. 9B illustrates a top perspective view of a lower portion of a housing for an embodiment of a mortar round glide kit.
Figure 9C:
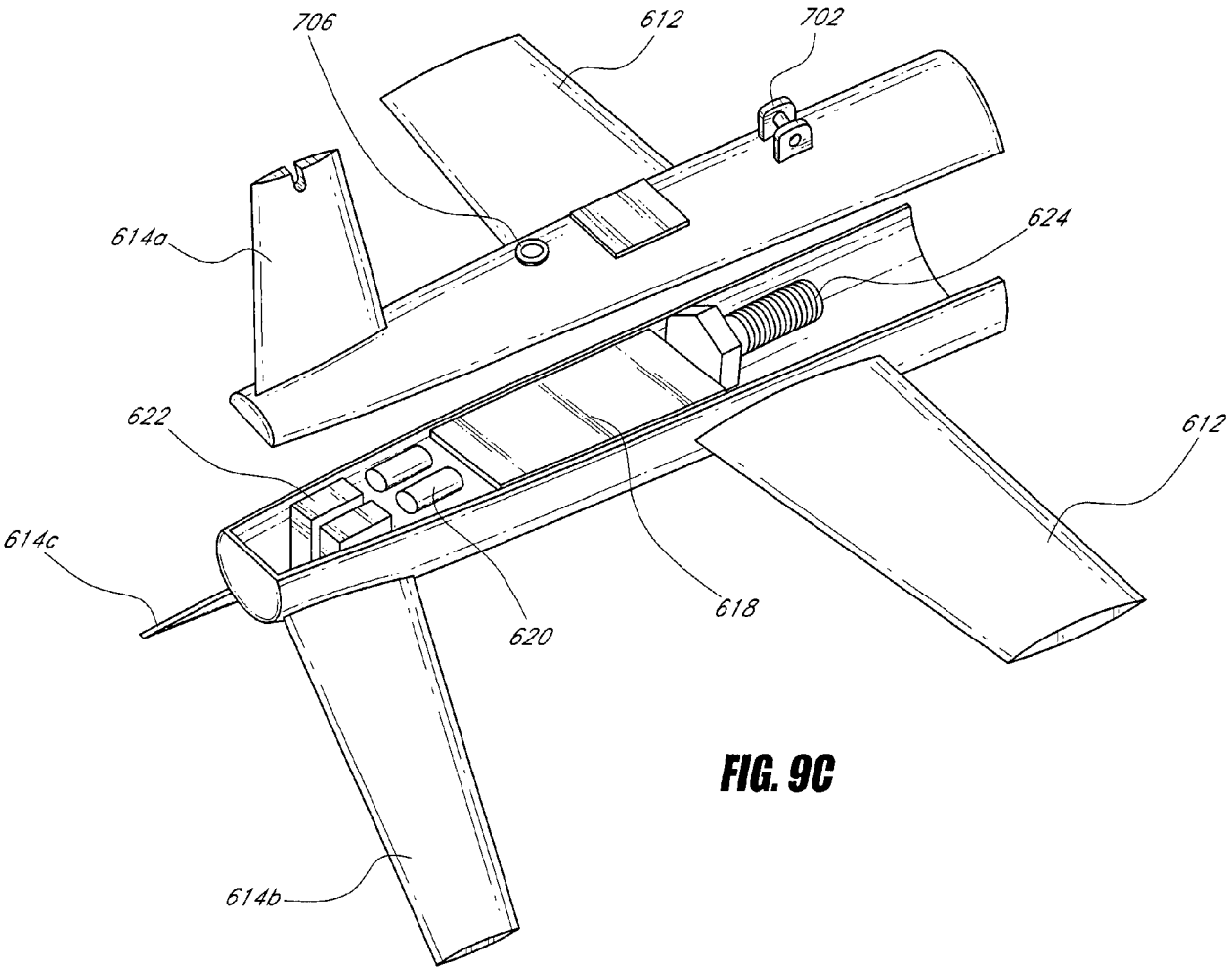
FIG. 9C illustrates an upper portion and a lower portion of a housing for an embodiment of a mortar round glide kit ready to be assembled.

In one embodiment, the housing 610 and one or more of the wings 612 and/or tail fins 614 can be molded from, for example, glass filled nylon. Of course, other materials can be used. FIGS. 9A-9C illustrate examples of molded parts. FIG. 9A illustrates a bottom perspective view of an upper portion of the housing 610. In one embodiment, the vertical tail fin 614*a* is molded with the upper portion of the housing 610. FIG. 9B illustrates a top perspective view of a lower portion of the housing 610. In a configuration in which the tail fins 614*b*, 614*c* do not steer, the tail fins 614*b*, 614*c* can also be molded with the lower portion of the housing 610. FIG. 9C illustrates an upper portion and a lower portion of the housing 610 with some components mounted.

Figure 10:
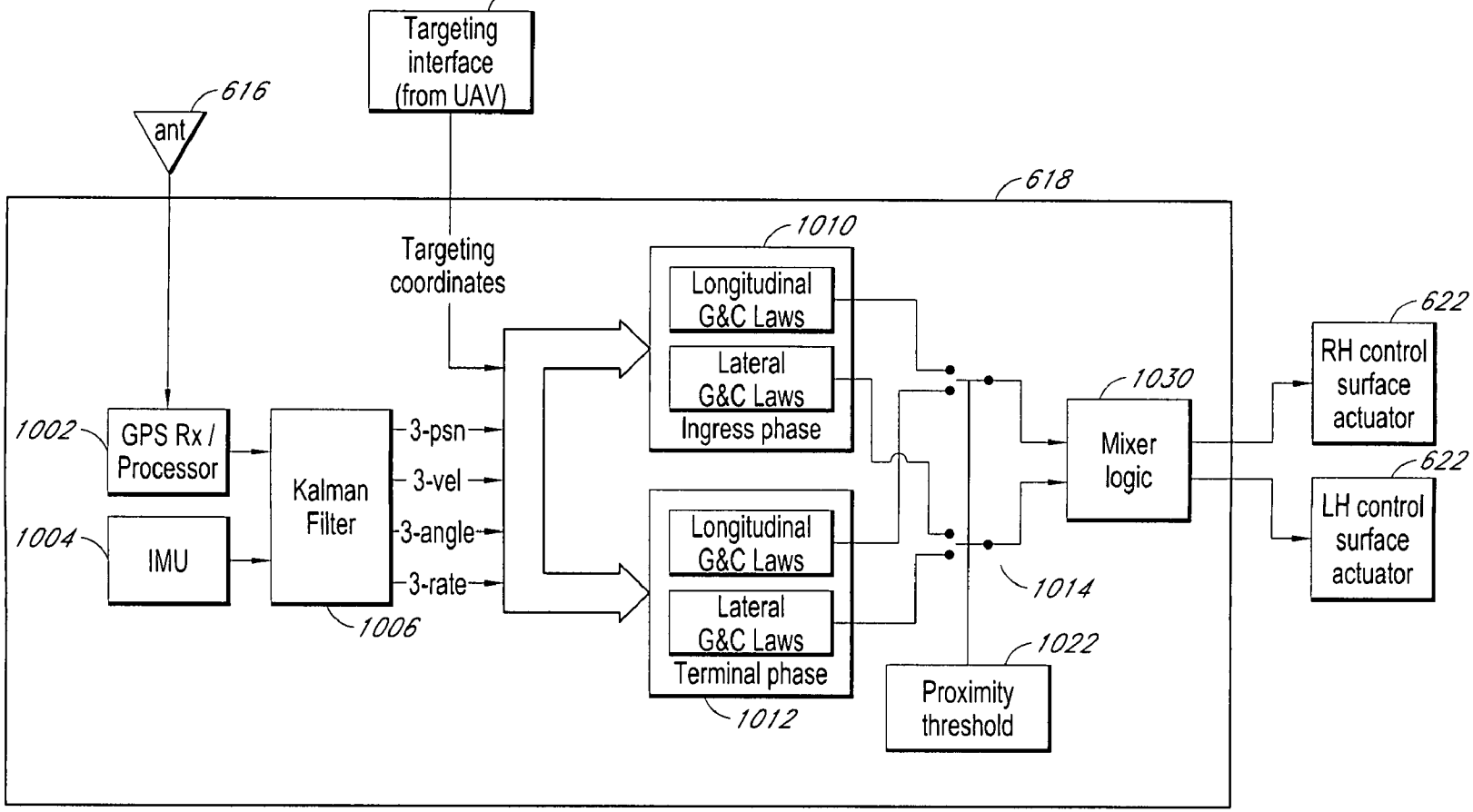
FIG. 10 is a block diagram illustrating functions of the control system.

FIG. 10 is a block diagram illustrating functions of the control system 618. In the illustrated embodiment, the control system 618 includes both a GPS block 1002 and an IMU 1004 for positioning. The GPS block 1002 illustrated in FIG. 10 can correspond to the GPS signal acquisition circuits, tracking loops, and navigation message decoding portions of a GPS receiver. For example, the GPS block 1002 can provide a Kalman filter 1006 with GPS position, velocity, and time, and the IMU 1004 can provide the Kalman filter 1006 with acceleration and a change in angle.

In the illustrated embodiment, the Kalman filter 1006 tightly couples the observations from the GPS block 1002 and the IMU 1004 to generate a three-axis navigation solution for position, velocity, body angle, and angular rate, which are provided as inputs to a guidance and flight control computer, which is represented by an ingress phase block 1010 and a terminal phase block 1012. The ingress phase block 1010 and the terminal phase block 1012 generate flight control surface settings based on the 3 axis position, velocity, body angle, and angular rate as provided by the Kalman filter 1006, on the target coordinates, and on guidance and control laws for the ingress phase. The target coordinates can be downloaded from a targeting interface 1020 of the UAV prior to launch, such as, for example, via a serial data line used with the breakaway connector 706. The ingress phase block 1010 can generate flight controls to glide the fitted mortar round assembly to relatively close to the target.

When the fitted mortar round assembly becomes relatively close to the target, such as in terms of a distance (such as radius from target) or time or a combination of both distance and time, a proximity threshold 1022 is reached and the control system 618 switches from guidance under the ingress phase block 1010 to guidance under the terminal phase block 1012 for a final approach to the target. For example, the proximity threshold 1022 can correspond to predetermined distance and/or time limits. The proximity threshold 1022 is illustrated controlling switches 1014, but it will be understood that the functions of the switches 1014 can be performed in software. In an alternative embodiment, only one set of flight control laws is used. In another embodiment, additional sets of flight control laws are used.

The terminal phase block 1012 can be configured to generate flight controls to, for example, dive relatively steeply. In one embodiment, the terminal phase block 1012 levels out flight before the dive. These flight characteristics are determined by the programmed guidance and control laws for the terminal phase. In another embodiment, the terminal phase block 1012 controls the flight surfaces to have the fitted mortar round assembly to climb before diving. Depending on the configuration of the control surfaces, mixer logic 1030 can be present. In the illustrated embodiment with tail fins 614*b*, 614*c* in an inverted "V" for control, the longitudinal (pitch) and lateral (roll/yaw) components of control are mixed to provide appropriate controls for the actuators or servos 622. Other components, such as drivers and buffers are not shown in the block diagram.

In one embodiment, the control system 618 includes 3 microprocessors, such as PowerPC 440 processors. A first processor implements satellite signal acquisition, tracking, and related functions as represented by the GPS block 1002. A second processor implements the Kalman filter 1006. A third processor implements the guidance and flight control computer to execute instructions for guidance and flight control as represented by the ingress phase block 1010, the terminal phase block 1012, switches 1014, proximity threshold 1022, mixer logic 1030.

Figure 11:
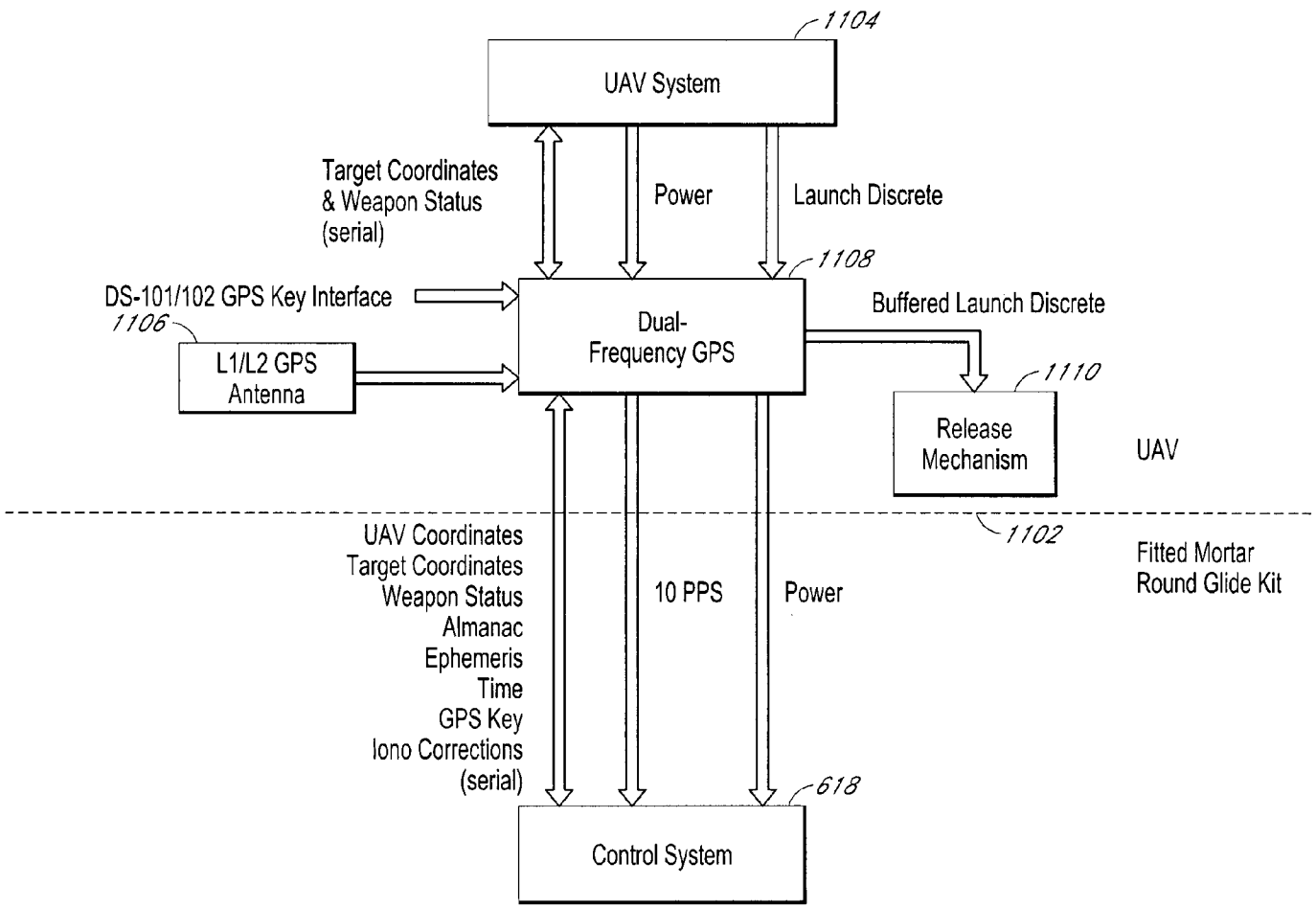
FIG. 11 is a block diagram illustrating communication and power between a UAV and a fitted mortar round assembly.

FIG. 11 is a block diagram illustrating communication and power between the UAV 100 and a fitted mortar round assembly. For the purposes of illustration, selected UAV components are above a dashed line 1102, while selected components of the fitted mortar round assembly are below the dashed line 1102. Power and data shown crossing the dashed line 1102 can utilize the breakaway connector 706 for connection. Of course, data can also be communicated wirelessly, such as via infrared or via radio frequency, such as bluetooth, WiFi or another standard, and can also be coupled inductively. DC power is typically coupled directly, but AC power can be coupled inductively.

The illustrated UAV components are a UAV system 1104, an L1/L2 GPS Antenna 1106, a dual-frequency GPS 1108, and a release mechanism 1110. The UAV system 1104 can receive commands from one or more ground stations. These commands can include targeting information to be passed onto a fitted mortar round assembly. The L1/L2 GPS antenna 1106 for the illustrated UAV receives both L1 and L2 frequency bands, and the dual-frequency GPS 1108 processes both L1 and L2 bands. For decryption of the military's P(Y) code, the decryption key can be provided to the dual-frequency GPS 1108 via the DS-101/102 GPS key interface. When indicated by, for example, a command or other control, the release mechanism 1110 releases or launches the fitted mortar round assembly.

In the illustrated configuration, the dual-frequency GPS 1108 is configured to pass its GPS data as well as target coordinates from the UAV system 1104 to the control system 618 of the fitted mortar round assembly, and weapon status data from the control system 618 to the UAV system 1104 and other health data, such as battery charge, self test results, and the like. Examples of GPS data include UAV coordinates, almanac, ephemeris, time, GPS key, and ionospheric corrections. In addition, a 10 PPS (pulses per second) signal can be used to provide the control system 618 with accurate timing based on the P(Y) code of GPS. Alternatively or additionally, a 1 PPS signal from the C/A code can be provided.

The foregoing description and claims may refer to elements or features as being "connected" or "coupled" together. As used herein, unless expressly stated to the contrary, "connected" means that one element/feature is directly or indirectly connected to another element/feature, and not necessarily mechanically. Likewise, unless expressly stated to the contrary, "coupled" means that one element/feature is directly or indirectly coupled to another element/feature, and not necessarily mechanically. Thus, although the various schematics shown in the figures depict example arrangements of elements and components, additional intervening elements, devices, features, or components may be present in an actual embodiment (assuming that the functionality of the depicted circuits is not adversely affected).

Various embodiments have been described above. Although described with reference to these specific embodiments, the descriptions are intended to be illustrative and are not intended to be limiting. Various modifications and applications may occur to those skilled in the art.

What is claimed is:

1. An apparatus comprising a kit for equipping a mortar round with the ability to glide when dropped from altitude, the apparatus comprising:

a housing configured to be attached to a rear portion of a mortar round;

a threaded joint configured to attach the housing to a rear portion of a mortar round, wherein the threaded joint is configured to engage with threads of a mortar round originally intended to engage with a tail section;

at least one wing configured to provide lift and two or more movable control surfaces configured to permit flight control, wherein the at least one wing and the two or more movable control surfaces permit a mortar round equipped with the kit to have a glide ratio of at least 1:1, wherein the glide ratio comprises a ratio of forward distance traveled to downwards distance traveled while gliding at constant speed;

at least one hard mounting point for coupling the housing, directly or indirectly, to a launcher;

one or more servos configured to actuate the movable control surfaces for flight control;

a control system configured to determine position and to guide the equipped mortar round via control of the servos to a designated target; and at least one interface for transfer of data and/or power between a launcher of an unmanned aerial vehicle and the control system.

2. The apparatus of claim 1, wherein the at least one wing is integrated with the housing.

3. The apparatus of claim 1, wherein the apparatus further comprises a replacement fuze configured to replace a standard mortar round fuze, wherein the replacement fuze is configured to transition from an unarmed state to an armed state upon detection of at least one of mechanical separation from the launcher and/or speed.

4. The apparatus of claim 1, wherein the control system comprises a global positioning system (GPS) receiver and a guidance and flight control computer, wherein the guidance and flight control computer is configured to have at least an ingress phase and a terminal phase of flight control, wherein the ingress phase and the terminal phase have different guidance and control laws, wherein the guidance and flight control computer is configured to initially select the ingress phase for control and then to switch to the terminal phase for a final approach to the target.

5. The apparatus of claim 1, wherein the glide ratio is at least 2:1.

6. An apparatus comprising a kit for equipping a mortar round with the ability to glide when dropped from altitude, the apparatus comprising:

a wing assembly comprising one or more rigid portions and two or more movable control surfaces for lift and control;

a threaded joint configured to attach the wing assembly to a mortar round, wherein the threaded joint is configured to engage with threads of a mortar round originally intended to engage with a tail section, so that with the wing assembly equipped, the mortar round has a glide ratio of at least 1:1, wherein the glide ratio comprises a ratio of forward distance traveled to downwards distance traveled while gliding at constant speed;

at least one hard mounting point for coupling the wing assembly, directly or indirectly, to a launcher;

a plurality of servos configured to actuate the movable control portions of the wing assembly for flight control;

a control system configured to determine position and to guide the equipped mortar round via control of the servos to a designated target; and at least one interface for transfer of data and/or power between a launcher of an unmanned aerial vehicle and the control system.

7. The apparatus of claim 6, wherein the glide ratio is at least 2:1.

8. The apparatus of claim 6, wherein a wingspan associated with the wing assembly is at least four times an outer diameter of the mortar round.

9. The apparatus of claim 6, wherein a wing of the wing assembly has a wing aspect ratio greater than 4.

10. The apparatus of claim 6, wherein the rigid portions of the wing assembly are fixed and extend such that the mortar round assembly does not fit into a mortar tube originally intended for the mortar round.

11. The apparatus of claim 6, wherein the rigid portions of the wing assembly comprise one or more deployable wings having a retracted position and a deployed position, wherein even when the one or more deployable wings are in the retracted position, the mortar round assembly does not fit into a mortar tube originally intended for the mortar round.

12. The apparatus of claim 6, wherein the control system comprises at least a global positioning system (GPS) receiver, and a guidance and flight control computer.

13. The apparatus of claim 6, wherein the control system comprises a global positioning system (GPS) receiver, an inertial measurement unit, and a guidance and flight control computer.

14. The apparatus of claim 6, wherein the control system comprises a global positioning system (GPS) receiver and a guidance and flight control computer, wherein the guidance and flight control computer is configured to have at least an ingress phase and a terminal phase of flight control, wherein the ingress phase and the terminal phase have different guidance and control laws, wherein the guidance and flight control computer is configured to initially select the ingress phase for control and then to switch to the terminal phase for a final approach to the target.

* * * * *